US010883761B2

(12) United States Patent
Vallee et al.

(10) Patent No.: US 10,883,761 B2
(45) Date of Patent: Jan. 5, 2021

(54) FLUID DISTRIBUTION DEVICE

(71) Applicant: Chart Energy & Chemicals, Inc., Ball Ground, GA (US)

(72) Inventors: Steven J. Vallee, La Crosse, WI (US); Zeke Skarlupka, Genoa, WI (US); Adam McNeilly, La Crosse, WI (US); Emma Carter, La Crosse, WI (US); Ryan Mehus, La Crescent, MN (US); Michael Ruskin, La Crosse, WI (US); Robert Robson, La Crosse, WI (US)

(73) Assignee: Chart Energy & Chemicals, Inc., Ball Ground, GA (US)

( * ) Notice: Subject to any disclaimer, the term of this patent is extended or adjusted under 35 U.S.C. 154(b) by 242 days.

(21) Appl. No.: 16/145,654

(22) Filed: Sep. 28, 2018

(65) Prior Publication Data

US 2019/0162470 A1 May 30, 2019

Related U.S. Application Data

(60) Provisional application No. 62/591,948, filed on Nov. 29, 2017.

(51) Int. Cl.

| | |
|---|---|
| ***F25J 3/06*** | (2006.01) |
| ***F25J 3/02*** | (2006.01) |
| ***F25J 5/00*** | (2006.01) |

(52) U.S. Cl.

CPC ..... *F25J 3/061* (2013.01); *F25J 3/0209* (2013.01); *F25J 3/0233* (2013.01); *F25J 3/0238* (2013.01);

(Continued)

(58) Field of Classification Search

CPC ..... F25J 3/061; F25J 3/0209; F25J 3/0233; F25J 3/0238; F25J 3/0242; F25J 5/002;

(Continued)

(56) References Cited

U.S. PATENT DOCUMENTS 3,919,859 A * 11/1975 Ross ..... F25B 1/00 62/503
4,517,811 A * 5/1985 Atsumi ..... F25B 41/06 62/197

(Continued)

*Primary Examiner* — Joel M Attey
(74) *Attorney, Agent, or Firm* — Cook Alex Ltd.; R. Blake Johnston

(57) ABSTRACT

A device for distributing a fluid to a processing component includes a vessel having an inlet port for receiving a stream of fluid. A vapor outlet line is in fluid communication with the fluid processing component and has a vapor outlet line inlet in fluid communication with the headspace of the vessel. A liquid outlet line has a liquid outlet line inlet in fluid communication with a liquid side of the vessel and the fluid processing component. A bypass line has a bypass line inlet in fluid communication with the liquid side of the vessel and a bypass line outlet in fluid communication with the vapor outlet line and is configured so that liquid travels through the bypass line and into the vapor outlet line when a liquid level within the vessel reaches a predetermined level so that a headspace is maintained above the liquid level as liquid enters the vessel through the inlet port, and liquid does not travel from the bypass line into the vapor outlet line when a liquid level within the vessel is below the predetermined level.

19 Claims, 6 Drawing Sheets

(52) U.S. Cl.
CPC ..... *F25J 3/0242* (2013.01); *F25J 3/0695* (2013.01); *F25J 5/002* (2013.01); *F25J 2205/04* (2013.01); *F25J 2280/02* (2013.01); *F25J 2290/32* (2013.01)

(58) Field of Classification Search
CPC .. F25J 2205/04; F25J 2280/02; F25J 2290/32; F25B 2400/23
USPC ..... 62/618
See application file for complete search history.

(56) References Cited

U.S. PATENT DOCUMENTS 4,551,983 A * 11/1985 Atsumi ..... F25B 41/00 62/174
2005/0247071 A1 * 11/2005 Nemit, Jr. ..... F25B 41/04 62/197

* cited by examiner

FLUID DISTRIBUTION DEVICE

CLAIM OF PRIORITY

This application claims the benefit of U.S. Provisional Application No. 62/591,948, filed Nov. 29, 2017, the contents of which are hereby incorporated by reference.

FIELD OF THE INVENTION

The present disclosure relates generally to fluid handling components and, in particular, to a fluid distribution device with a bypass line to accommodate both a mixed-phase inlet stream and an all-liquid inlet stream.

BACKGROUND

Midstream natural gas processing plants receive pipeline natural gas feed streams, indicated at 10 in FIG. 1, and remove hydrocarbons as liquids (NGL—natural gas liquids) to sell into secondary markets. The pipeline gas feed stream received by the processing plant is primarily comprised of methane, ethane, propane, and butane.

Methane is the most basic hydrocarbon and is used as a fuel for heating in homes connected to the pipeline gas infrastructure. Methane can also be used as fuel in vehicle, rail, marine, and mining applications. Methane may also be liquefied (LNG) in order to ship it to areas where a well-developed infrastructure is not established or natural gas is not abundant.

In order to remove NGL from the gas feed stream, with reference to block 12 of FIG. 1, the gas is cooled to the point where the heavier hydrocarbons start to drop out as liquids while the lighter hydrocarbons remain in the stream as vapor (gas). Gas processing plants typically are most interested in removing the propane and butane from the feed gas stream. However, there are times where ethane is also a desirable component that will be removed from the stream as a liquid. The chief application for the ethane as a commodity is fractionation and subsequent sale as a feedstock for the petrochemical industry to make ethylene. The terms ethane-rejection and ethane-recovery refer to the plant's operation. In ethane-rejection, i.e. the rejection case, ethane is rejected and not removed from the gas stream. Conversely, in ethane-recovery, i.e. the recovery case, ethane is recovered from the gas stream by liquefying it.

The decision for the plant to operate in either mode is determined based on a number of factors. These factors include the spot price of ethane, plant inlet conditions, gas stream composition, product specifications for the NGL, product specifications for the gas returned to the pipeline, and plant design and operability. As the factors fluctuate, each plant will have different ethane spot prices at which it is advantageous to recover or reject the ethane. Also, the recovery of propane and butane is higher when recovering ethane than when rejecting ethane, so the efficiency gain must be considered in the decision of when to switch between the modes of operation.

Gas processing plants often use a brazed aluminum heat exchanger (BAHX) 14 (FIG. 1) to further cool the stream 16 (which may contain liquid methane and ethane gas) after the above initial processing. In order to control the phase distribution of a two-phase stream entering the BAHX, the two-phase stream 16 may be first separated into individual liquid 18 and vapor 22 streams using a separation vessel or distribution device 24 and then mixed internally after introduction into the BAHX 14. The internal mixing devices of the BAHX are static devices designed to function optimally over a limited range of liquid and vapor flowrates. Multiple design cases with drastically different flow rates can be sub-optimal for a typical mixing device.

In the rejection case described above, there is a stream with two-phase flow (liquid methane and ethane gas) to the BAHX and a two-phase distribution device is desired to control the distribution of the phases into the BAHX. In the recovery case described above, the process stream is all liquid (methane) at a higher flowrate. For a traditional distribution device designed for the rejection case, during operation of the recovery case, the separation vessel may flood and/or create an unfavorable condition in the mixing device.

SUMMARY

There are several aspects of the present subject matter which may be embodied separately or together in the devices and systems described and claimed below. These aspects may be employed alone or in combination with other aspects of the subject matter described herein, and the description of these aspects together is not intended to preclude the use of these aspects separately or the claiming of such aspects separately or in different combinations as set forth in the claims appended hereto.

In one aspect, a device for distributing a fluid to a processing component includes a vessel having an inlet port configured to receive a stream of fluid. A vapor outlet line has a vapor outlet line inlet in fluid communication with the vessel above the inlet port so as to be in fluid communication with a headspace of the vessel. The vapor outlet line is also configured to be placed in fluid communication with the fluid processing component. A liquid outlet line has a liquid outlet line inlet in fluid communication with a liquid side of the vessel and is also configured to be placed in fluid communication with the fluid processing component. A bypass line has a bypass line inlet in fluid communication with the liquid side of the vessel and a bypass line outlet in fluid communication with the vapor outlet line and is configured so that i) liquid travels through the bypass line and into the vapor outlet line when a liquid level within the vessel reaches a predetermined level so that a headspace is maintained above the liquid level as liquid enters the vessel through the inlet port and ii) liquid does not travel from the bypass line into the vapor outlet line when a liquid level within the vessel is below the predetermined level.

In another aspect, a fluid processing system includes a heat exchanger and a device for distributing the fluid to the heat exchanger. The device for distributing the fluid to the heat exchanger includes a vessel having an inlet port configured to receive a stream of fluid. A vapor outlet line has a vapor outlet line inlet in fluid communication with the vessel above the inlet port so as to be in fluid communication with a headspace of the vessel. The vapor outlet line is also configured to direct fluid to the heat exchanger. A liquid outlet line has a liquid outlet line inlet in fluid communication with a liquid side of the vessel and is also configured to direct fluid to the heat exchanger. A bypass line has a bypass line inlet in fluid communication with the liquid side of the vessel and a bypass line outlet in fluid communication with the vapor outlet line and is configured so that i) liquid travels through the bypass line and into the vapor outlet line when a liquid level within the vessel reaches a predetermined level so that a headspace is maintained above the liquid level as liquid enters the vessel through the inlet port and ii) liquid does not travel from the bypass line into the vapor outlet line when a liquid level within the vessel is below the predetermined level.

In still another aspect, a method of distributing a fluid to a processing component includes the steps of receiving a fluid stream into a distribution device; separating the received fluid stream into a vapor stream and a liquid stream if the fluid stream is a mixed-phase stream, and directing the liquid stream along a liquid path to the processing component and directing the vapor stream along a vapor path to the processing component; and directing liquid streams along both the liquid path and also the vapor path to the processing component if the received fluid stream is generally an all liquid stream.

DETAILED DESCRIPTION OF EMBODIMENTS

Figure 1:
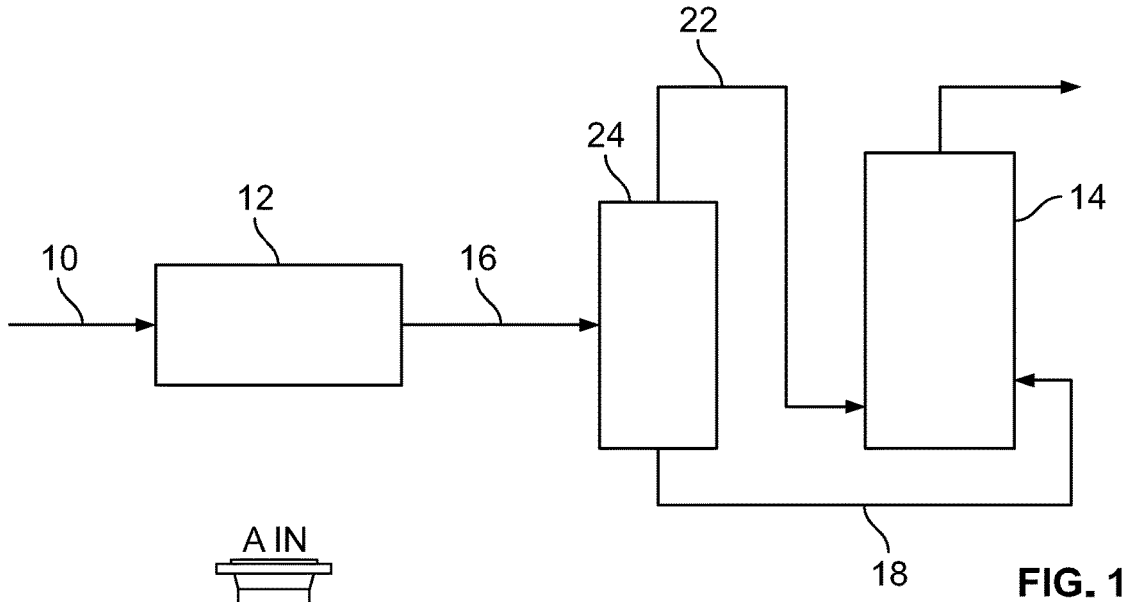
FIG. 1 (Prior Art)
FIG. 1 is a schematic view of a prior art cryogenic fluid processing system.

A first embodiment of the distribution device of the disclosure is indicated in general at 30 in FIGS. 2-5. While the invention is described below in terms of use with a cryogenic fluid, it may be used with non-cryogenic fluids as well. The distribution device 30 includes a vessel 31 (with the terms, "separation vessel" and "vessel" used interchangeably) that includes an inlet port 32 provided with an inlet port nozzle 34 for connecting piping that carries an inlet stream thereto. A pair of liquid outlet lines 36*a* and 36*b* extend between a lower portion of the vessel 31 and the lower portion of a heat exchanger 40 (which may or may not be a BAHX). In addition, a vapor outlet line 42 extends between an upper portion of the vessel 31 and the lower portion of the heat exchanger 40. In alternative embodiments, additional liquid outlet and vapor outlet lines may be used, and/or a single liquid outlet line may be used. In addition, the liquid outlet and vapor outlet lines may extend to alternative locations and portions of the heat exchanger other than those illustrated.

Figure 2:
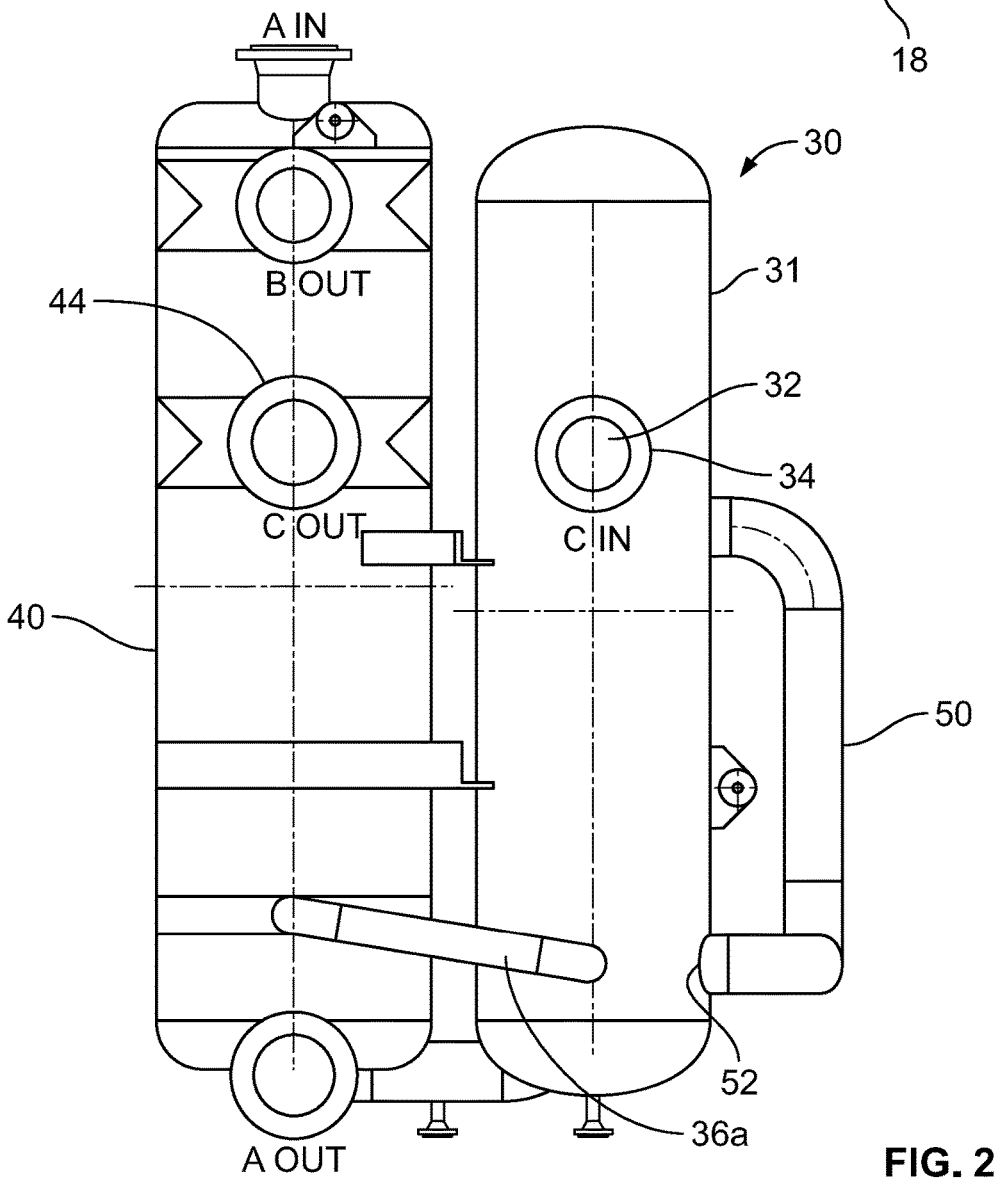
FIG. 2 is a first side elevational view of a first embodiment of the distribution device of the disclosure and a heat exchanger.
Figure 4:
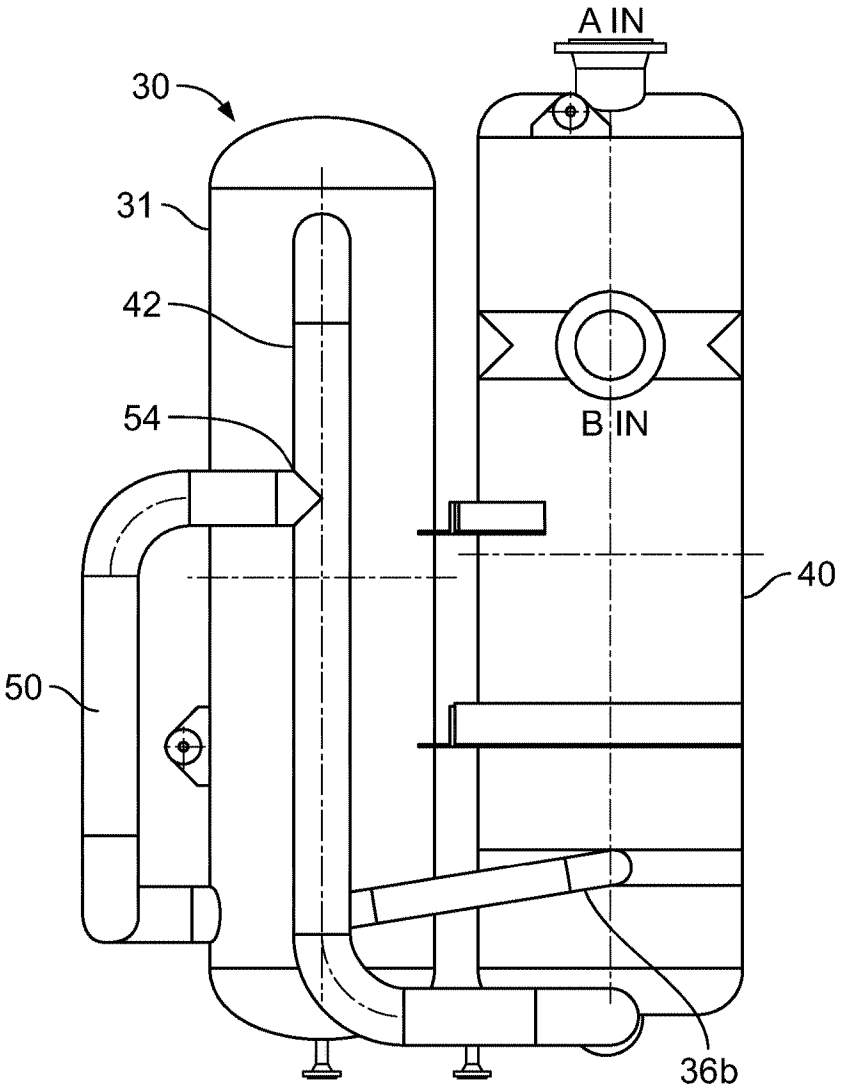
FIG. 4 is a third side elevational view of the embodiment of the distribution device of the disclosure and a heat exchanger.
Figure 3:
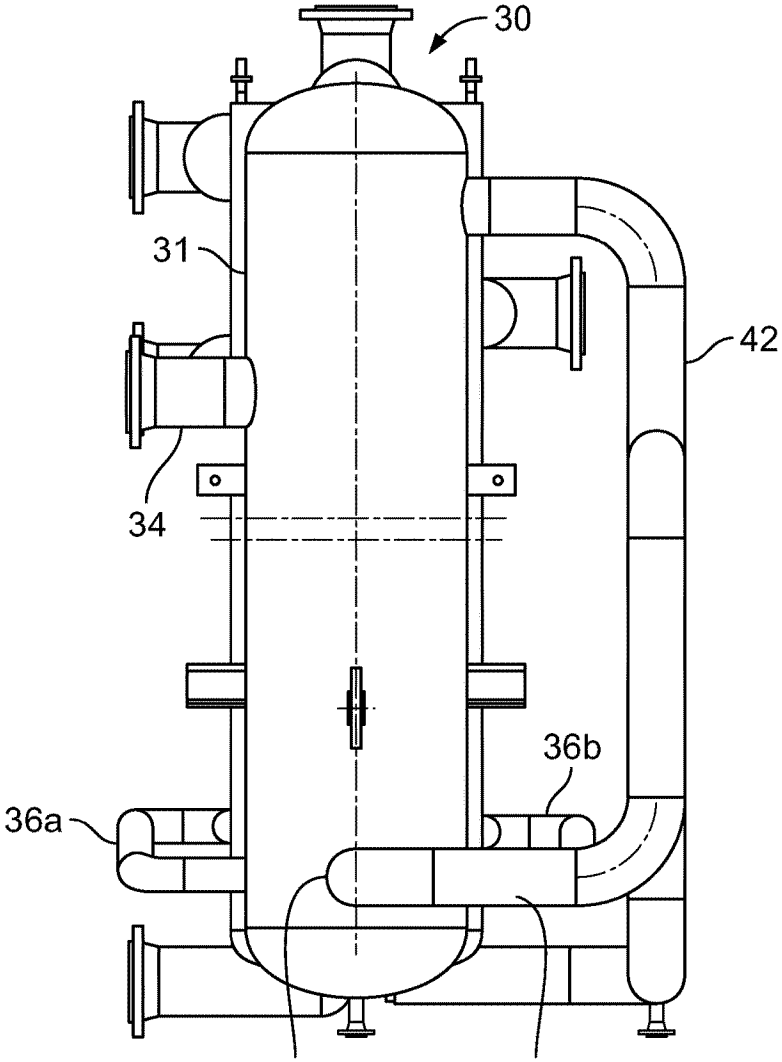
FIG. 3 is a second side elevational view of the embodiment of the distribution device of the disclosure and a heat exchanger.
Figure 5:
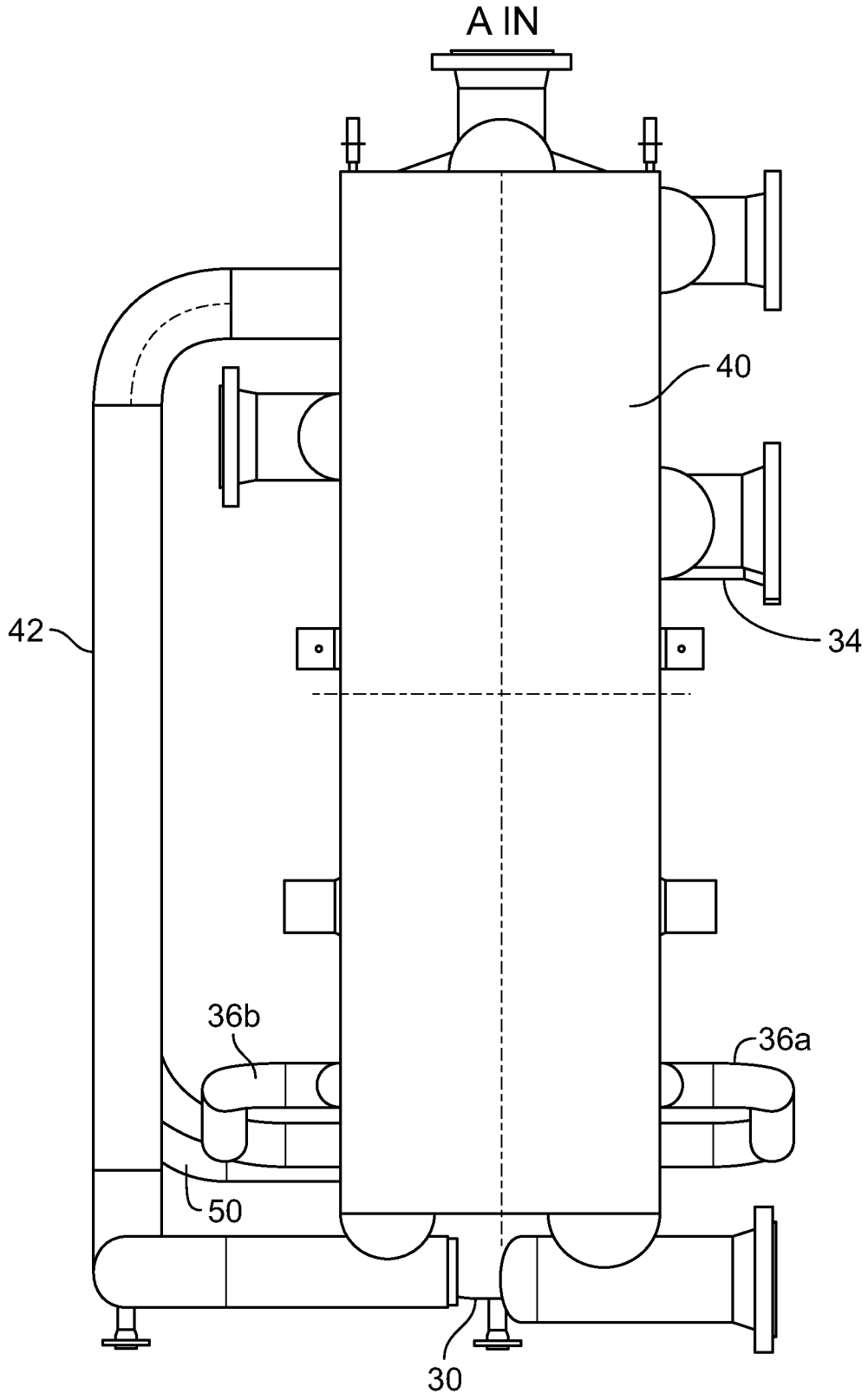
FIG. 5 is a fourth side elevational view of the embodiment of the distribution device of the disclosure and a heat exchanger.

As is known in the art, the heat exchanger 40 includes a number of additional fluid inlet and outlet ports 44 (FIG. 2).

While the distribution device of the disclosure is described below in terms of use with a heat exchanger for natural gas processing, et may be used in the processing of alternative types of fluid streams and with other types of fluid processing components, in addition, the terms "stream", "pipe", "piping" and "line" are used interchangeably. The terms "upper portion" and "lower portion" of the vessel 31 mean above and below a horizontal plane passing through the liquid level inside the vessel.

A bypass line 50 leads from a junction 52 (FIGS. 2 and 3) in the liquid side or lower portion of the vessel 31 to a junction 54 (FIG. 4) in the vapor outlet line 42. Junction 54 is positioned vertically above the liquid outlet ports of the vessel corresponding to liquid outlet lines 36*a* and 36*b* and the junction 52. While a single bypass line 50 is illustrated and described below, embodiments of the distribution device of the disclosure may include more than one bypass line leading to locations on the vapor outlet line 42 other than what is illustrated in the figures. Furthermore, in alternative embodiments, junction 52 (i.e. the bottom end(s) of the bypass line(s) 50) may be positioned within either one or both of the liquid outlet lines 36*a* and 36*b* instead of in the liquid side or lower portion of the vessel 31.

During the rejection case, a two-phase stream (liquid and vapor) enters the distribution device 30 though the inlet port 32 and is separated so that the vapor portion rises to the headspace in the upper portion of the vessel, while the liquid portion drops to the liquid side in the lower portion of the vessel 31 and enters the bypass line 50 through junction 52. The liquid levels in the vessel 31 and the bypass line 50 equalize at the same height and remain below the junction 54 (FIG. 4) of the bypass line 50 and the vapor outlet line 42. As a result, there is no liquid flow out of the bypass line 50 through junction 54 and into the vapor outlet line 42 during the rejection case. The vapor in the headspace of the vessel travels through line 42 to the bottom portion of the heat exchanger 40, while the liquid in the bottom portion of the vessel 31 travels through lines 36*a* and 36*b* to the heat exchanger 40.

During the recovery case, only an all liquid phase stream (which may or may not contain a trace amount of vapor) travels into the vessel of the distribution device 30 through the inlet port 32, with the all liquid flow at a higher flowrate. The liquid flows into the lower portion of the vessel and into bypass line 50 through junction 52 (as well as out of the liquid outlet lines 36*a* and 36*b*). The liquid level in both the vessel and the bypass line may rise until the liquid in the bypass line reaches the level of junction 54. Liquid then flows through the bypass line 50, through junction 54, into the vapor outlet line 42 and then into the heat exchanger 40, as well as through liquid outlet lines 36*a* and 36*b*. As a result, the bypass line 50 limits the liquid level in the vessel 31. Since the liquid level is limited, the liquid head in the vessel that drives the liquid flow through that portion of the distribution device is limited.

As noted previously, the excess liquid from the bypass line 50 enters the heat exchanger via the rejection case vapor path (in line 42). This alternative path through the heat exchanger provides an open area that can accommodate the liquid flowrate from the bypass line 50 at a rate sufficient to avoid flooding the vessel 31.

The length (height) of the vessel of the distribution device 30 is determined to accommodate the range of liquid levels (during the recovery and rejection cases) calculated from the design conditions, plus some extra distance to keep the liquid level away from the inlet nozzle so the incoming stream through port 32 does not re-entrain liquid from the liquid level surface within the vessel 31. For this reason, the intersection (54 in FIG. 4) of the bypass line 50 with the vapor outlet line 42 path may also preferably be below the inlet nozzle 34. The vessel length is also long enough to provide some liquid residence time so that it does not run dry from a minor upset from design conditions and at plant downturn conditions.

The elevation difference between the liquid level in the distribution device 30 and the liquid injection device in heat exchanger 40 (liquid head) is equal to the difference between the liquid path pressure drop and the vapor path pressure drop. The liquid path pressure drop is the pressure drop along the path from inside the vessel 31 through liquid outlet lines 36*a* and 36*b* and the corresponding mixing devices inside the heat exchanger 40 up to the point where the liquid streams mix with the vapor in the heat exchanger. The vapor path pressure drop is the pressure drop along the path from inside the vessel through the vapor outlet line 42 and the corresponding mixing device(s) inside the heat exchanger 40 up to the point where the vapor stream mixes with the liquid in the heat exchanger. As an example only, the liquid level elevation difference in the vessel may be generally 6"-84".

The vessel inlet port 32 is sized to reduce the fluid velocity entering the vessel, which aids in the vapor-liquid separation. An inlet baffle or inlet device might be used in some cases to improve the hydraulics.

When the liquid flow rate to the internal mixing device is high, it can be helpful to feed the heat exchanger from multiple connections, as illustrated in FIGS. 2-5 via liquid outlet lines 36*a* and 36*b*.

In alternative embodiments of the device of the disclosure, the vessel 31 of the distribution device could be connected to many heat exchanger blocks operating in parallel. Vapor and liquid path piping are connected to each of the heat exchanger cores via one or more manifolds in such embodiments, but the distribution device 30 would still function similarly.

Depending on the requirements for the internal mixing device(s) of the heat exchanger 40, the liquid could be fed from multiple connections for each heat exchanger core block.

Vapor and liquid nozzle locations (for lines 42 and 36*a* and 36*b*) on the vessel 31 could be on the side of the vessel or off the top (for the vapor) or bottom (for the liquid). Multiple nozzles from the vessel 31 could be used for either the vapor or the liquid outlet lines depending on the layout inside the cold box (within which the heat exchanger is contained) and number of heat exchanger cores and sides fed.

The liquid path piping 36*a* and 36*b* may be drainable back to the vessel, which may have a drain itself, and the vapor path piping 42 may have a drain so that when the plant is shut down, all process liquid can be removed.

Figure 6:
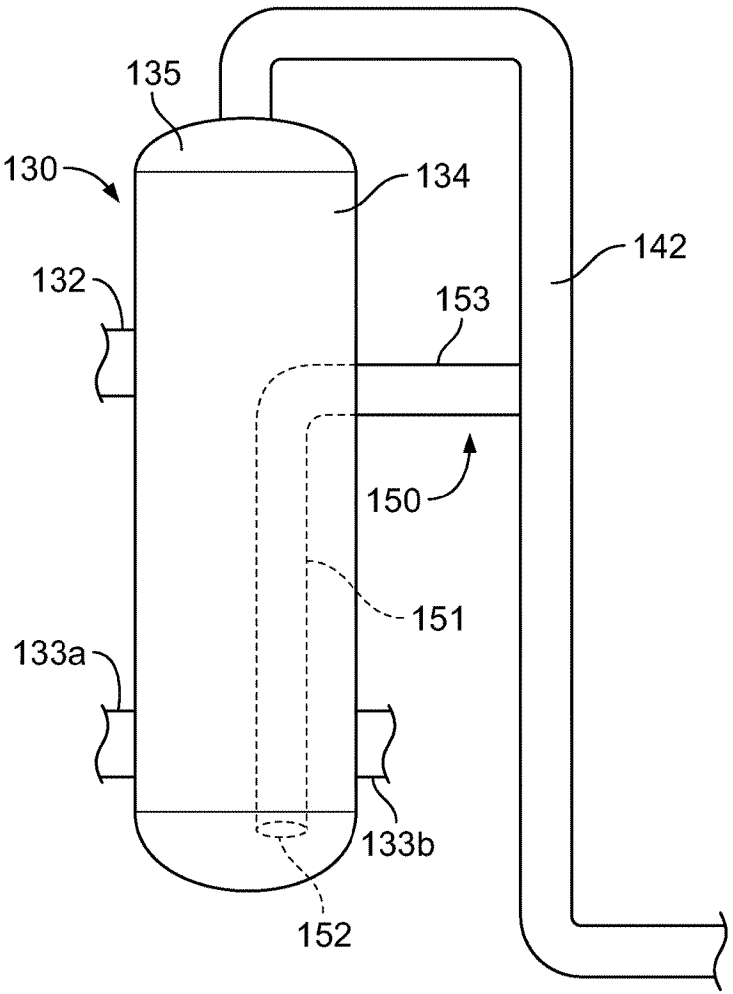
FIG. 6 is schematic view of a second embodiment of the distribution device of the disclosure.

A second embodiment of the distribution device of the disclosure is indicated in general at 130 in FIG. 6. The distribution device 130 includes a vessel 134 having an inlet port 132 for connecting piping that carries a fluid inlet stream thereto. Liquid outlet lines connect to liquid outlet ports 133*a* and 133*b* and extend to a heat exchanger or other fluid processing device (as illustrated for the previous embodiment). In addition, a vapor outlet line 142 is connected to the top end cap 135 of the vessel 134, so as to be in fluid communication with the headspace of the device, and extends to the fluid processing device (as illustrated for the previous embodiment).

In alternative embodiments, additional liquid outlet and vapor outlet lines may be used, and/or a single liquid outlet line may be used. In addition, the liquid outlet and vapor outlet lines may extend to alternative locations and portions of the heat exchanger other than those illustrated.

A bypass line, indicated in general at 150 in FIG. 6, leads from the liquid side of the distribution device 130 to the vapor outlet line 142. More specifically, the bypass line includes an elongated pipe portion 151 positioned within the vessel. The elongated pipe portion includes a bottom end having a bypass line inlet 152. The top end of the elongated pipe portion 151 is in fluid communication with a branch portion 153 that passes through a sidewall of the vessel 134 and is attached to, and in fluid communication with, the vapor outlet line 142.

While a single bypass line 150 is illustrated and described below, embodiments of the distribution device of the disclosure may include more than one bypass line leading to locations on the vapor outlet line 142 other than what is illustrated in the figures.

During the rejection case, a two-phase stream (liquid and vapor) enters the distribution device 130 though the inlet port 132 and is separated so that the vapor portion rises to the headspace in the upper portion of the vessel, while the liquid portion drops to the liquid side in the lower portion of the vessel 134 and enters the elongated pipe portion 151 of the bypass line 150 through inlet 152. The liquid levels in the elongated pipe portion 151 and the vessel 134 equalize at the same height and remain below the branch portion 153 of the bypass line 150. As a result, there is no liquid flow out of the bypass line 150 and into the vapor outlet line 142 during the rejection case. The vapor in the headspace of the vessel 134 travels through line 142 to the fluid processing device, while the liquid in the bottom portion of the vessel 134 travels through lines connected to liquid outlet ports 133*a* and 133*b* to the fluid processing device.

During the recovery case, only an all liquid phase stream (which may or may not contain a trace amount of vapor) travels into the distribution device 130 through the inlet port 132, with the all liquid flow at a higher flowrate. The liquid flows into the lower portion of the vessel 134 and into bypass line 150 through inlet 152 (as well as out of the liquid outlet ports 133*a* and 133*b*). The liquid level in both the vessel 134 and the elongated pipe portion 151 may rise until the liquid in the bypass line reaches the branch portion 153. Liquid then flows through the bypass line 150 into the vapor outlet line 142 and then into the fluid processing device as well as through liquid outlet ports 133*a* and 133*b*. As a result, the bypass line 150 limits the liquid level in the vessel 134. Since the liquid level is limited, the liquid head in the vessel that drives the liquid flow through that portion of the distribution device is limited.

Figure 7:
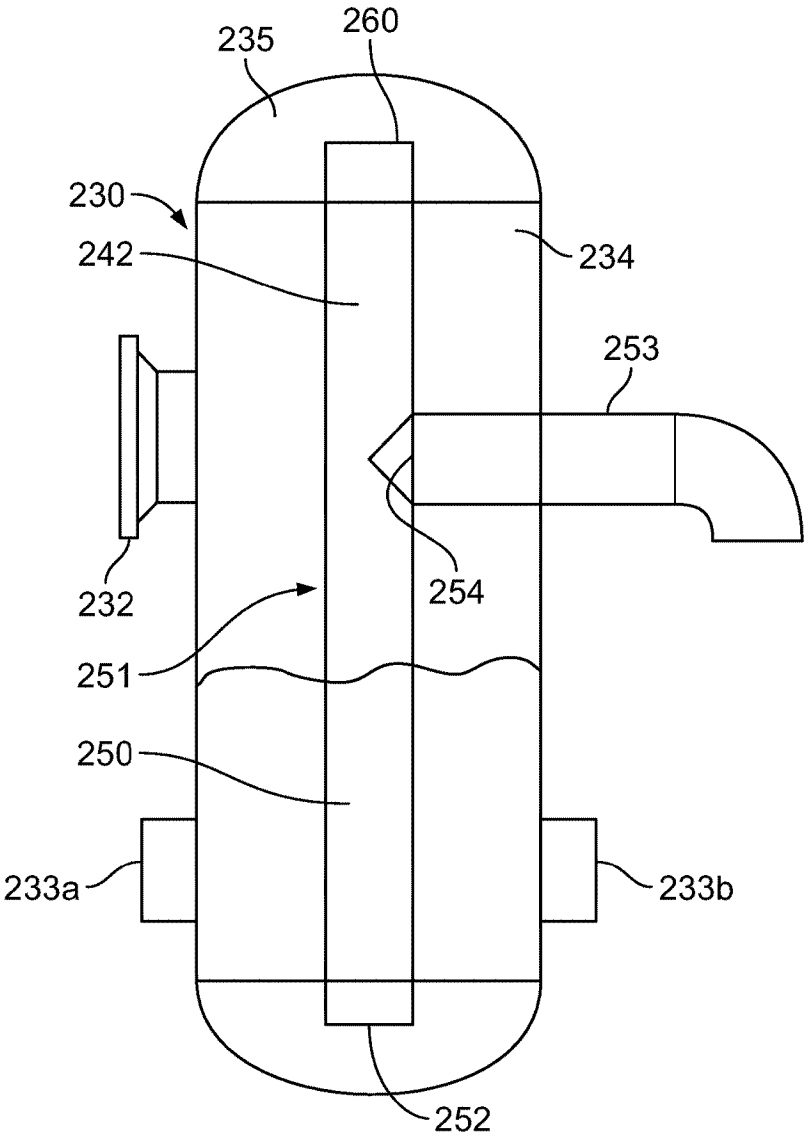
FIG. 7 is a schematic of a third embodiment of the distribution device of the disclosure.
Figure 8:
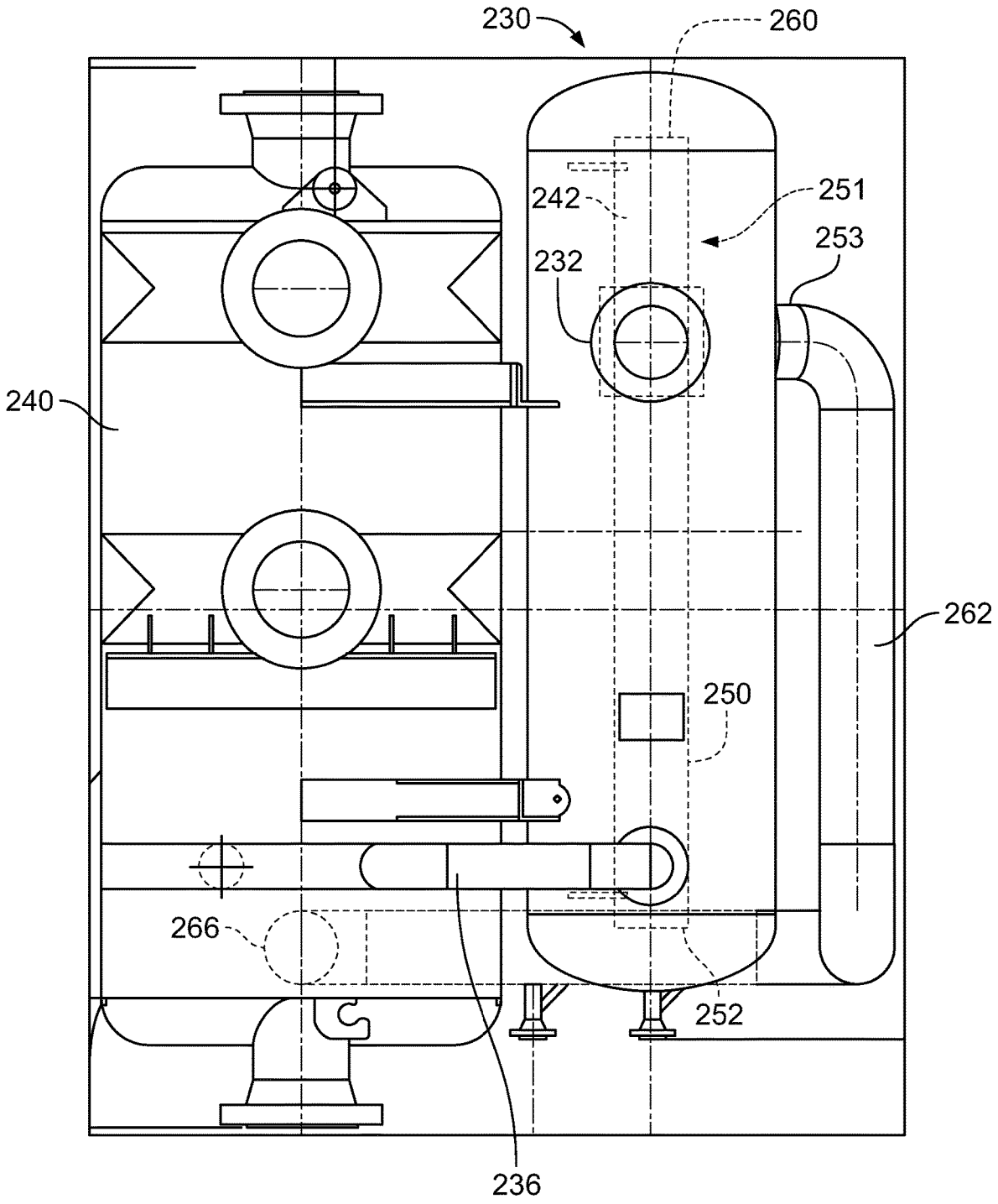
FIG. 8 is a side elevational view of the third embodiment of the distribution device of the disclosure and a heat exchanger.
Figure 9:
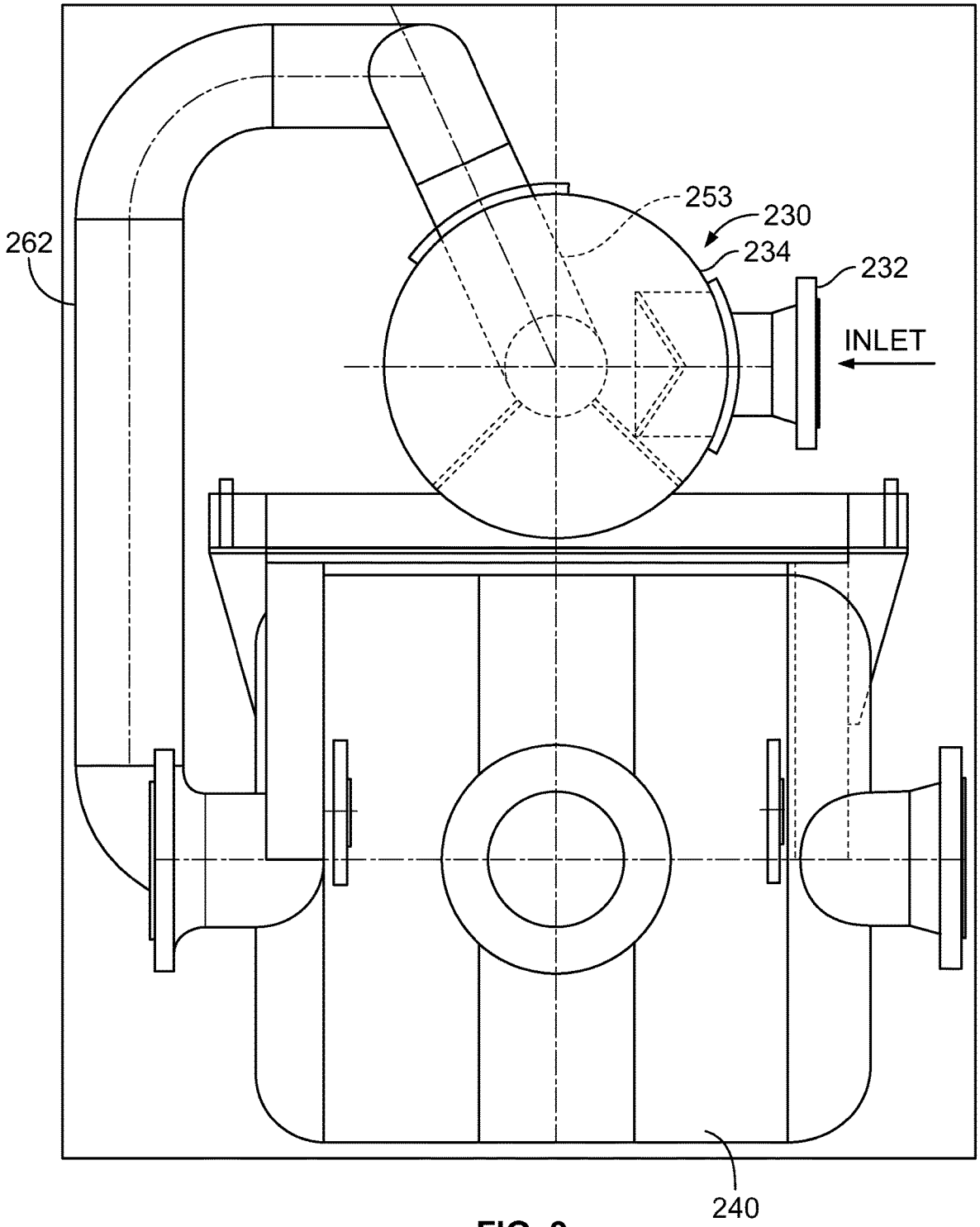
FIG. 9 is a top plan view of the third embodiment of the distribution device of the disclosure and a heat exchanger.

A third embodiment of the distribution device of the disclosure is indicated in general at 230 in FIGS. 7-9. The distribution device 230 includes a vessel 234 having an inlet port 232 for connecting piping that carries a fluid inlet stream thereto. Liquid outlet lines (one of which is illustrated at 236 in FIG. 8) connect to liquid outlet ports 233*a* and 233*b* and extend to a heat exchanger (240 in FIGS. 8 and 9) or other fluid processing device.

With reference to FIG. 7, the distribution device 230 features a vapor outlet line that includes an upper pipe portion 242 positioned within the vessel and having a vapor outlet line inlet 260 in fluid communication with the headspace 235 of the vessel 234. The vapor outlet line further includes a branch portion 253 extending through the sidewall of vessel 234 and in fluid communication with the upper pipe portion 242 via junction 254. With reference to FIGS. 8 and 9, the branch portion 253 leads to the fluid processing device 240 via piping 262 and port 266 (FIG. 8).

The distribution device 230 also includes a bypass line having a lower pipe portion 250 positioned within the vessel and having a bypass line inlet 252.

In the embodiment illustrated in FIGS. 7-9 the upper and lower pipe portions 242 and 250 are formed by a single pipe member, indicated in general at 251, positioned within the vessel. In alternative embodiments, the upper and lower pipe portions 242 and 250 may be separate pipe segments.

The lower pipe portion 250 of the bypass line leads from, and is in fluid communication with, the liquid side of the vessel 234, via bypass line inlet 252, to the upper pipe portion 242 and branch portion 253 of the vapor outlet line.

During the rejection case, a two-phase stream (liquid and vapor) enters the distribution device 230 though the inlet port 232 and is separated so that the vapor portion rises to the headspace in the upper portion of the vessel 234, while the liquid portion drops to the liquid side in the lower portion of the vessel 234 and enters the lower pipe portion 250 of the bypass line inlet 252. The liquid levels in the lower pipe portion 250 of the pipe member 251 and vessel 234 equalize at the same height and remain below the branch portion 253. As a result, there is no liquid flow out of the lower pipe portion 250 through junction 254 and into the branch portion 253 during the rejection case.

The vapor in the headspace of the vessel 234 travels through upper pipe portion 242, out branch portion 253 and to the fluid processing device 240 via piping 262 (FIGS. 8 and 9), while the liquid in the bottom portion of the vessel 234 travels through lines connected to liquid outlet ports 233*a* and 233*b* (such as line 236 in FIG. 8) to the fluid processing device 240.

During the recovery case, only an all liquid phase stream (which may or may not contain a trace amount of vapor) travels into the distribution device 230 through the inlet port 232, with the all liquid flow at a higher flowrate. The liquid flows into the lower portion of the vessel 234 and into lower pipe portion 250 through inlet 252 (as well as out of the liquid outlet ports 233*a* and 233*b*). The liquid level in both the vessel 234 and the lower pipe portion 250 may rise until the liquid in the bypass line reaches the branch portion 253. Liquid then flows through the bypass line branch portion 253 into the piping 262 (FIGS. 8 and 9) and then into the fluid processing device 240 (via port 266 of FIG. 8) as well as through liquid outlet ports 233*a* and 233*b*. As a result, the lower pipe portion 250 and the branch portion 253 limit the liquid level in the vessel 234. Since the liquid level is limited, the liquid head in the vessel that drives the liquid flow through that portion of the distribution device is limited.

While the preferred embodiments of the disclosure have been shown and described, it will be apparent to those skilled in the art that changes and modifications may be made therein without departing from the spirit of the disclosure, the scope of which is defined by the following claims.

What is claimed is:

1. A device for distributing a fluid to a processing component comprising:

a. a vessel having an inlet port configured to receive a stream of fluid;

b. a vapor outlet line having a vapor outlet line inlet in fluid communication with the vessel above the inlet port so as to be in fluid communication with a headspace of the vessel, said vapor outlet line also configured to be placed in fluid communication with the fluid processing component;

c. a liquid outlet line having a liquid outlet line inlet in fluid communication with a liquid side of the vessel, said liquid outlet line also configured to be placed in fluid communication with the fluid processing component;

d. a bypass line having a bypass line inlet in fluid communication with the liquid side of the vessel and a bypass line outlet in fluid communication with the vapor outlet line and configured so that;

i) liquid travels through the bypass line and into the vapor outlet line when a liquid level within the vessel reaches a predetermined level so that a headspace is maintained above the liquid level as liquid enters the vessel through the inlet port; and ii) liquid does not travel from the bypass line info the vapor outlet line when a liquid level within the vessel is below the predetermined level.

2. The device of claim 1 wherein the vessel has an upper portion and a lower portion and the vapor outlet line is connected to the upper portion of the vessel above the inlet port and the liquid outlet line is connected to the lower portion of the vessel.

3. The device of claim 2 further comprising more than one liquid outlet line connected to the lower portion of the vessel so as to be in fluid communication with a liquid side of the vessel, said more than one liquid outlet line also configured to be placed in fluid communication with the processing component.

4. The device of claim 2 wherein the bypass line is in fluid communication with the lower portion of the vessel via a junction between the bypass line and the lower portion of the vessel that is vertically below a junction between the bypass line and the vapor outlet line.

5. The device of claim 2 wherein the bypass line is in fluid communication with the lower portion of the vessel via a junction between the bypass line and the vessel liquid outlet line that is vertically below a junction between the bypass line and the vapor outlet line.

6. The device of claim 1 wherein the bypass line outlet is in fluid communication with the vapor outlet line at a junction, where the junction is positioned vertically below the vessel vapor outlet port.

7. The device of claim 1 wherein the bypass line includes an elongated pipe portion positioned within the vessel, said elongated pipe portion having a bottom end including the bypass line inlet and a top end in fluid communication with the vapor outlet line.

8. The device of claim 7 wherein the vessel includes a sidewall and the bypass line further includes a branch portion extending through the vessel sidewall and between the vapor outlet line and the elongated pipe portion.

9. The device of claim 1 wherein the vessel includes a sidewall and the vapor outlet line includes an upper pipe portion positioned within the vessel and including the vapor outlet line inlet, said vapor outlet line further including a branch portion extending through the vessel sidewall and in fluid communication with the upper pipe portion.

10. The device of claim 9 wherein the bypass line includes a lower pipe portion positioned within the vessel and including the bypass line inlet and the bypass line outlet.

11. The device of claim 10 wherein the upper and lower pipe portions are formed by a single pipe member positioned within the vessel.

12. A fluid processing system comprising:

a. a heat exchanger;

b. a device for distributing the fluid to the heat exchanger including:

i. a vessel having an inlet port configured to receive a stream of fluid;

ii. a vapor outlet line having a vapor outlet line inlet in fluid communication with the vessel above the inlet port so as to be in fluid communication with a headspace of the vessel, said vapor outlet line also configured to direct fluid to the heat exchanger;

iii. a liquid outlet line having a liquid outlet line inlet in fluid communication with a liquid side of the vessel, said liquid outlet line also configured to direct fluid to the heat exchanger;

iv. a bypass line having a bypass line inlet in fluid communication with the liquid side of the vessel and a bypass line outlet in fluid communication with the vapor outlet line and configured so that;

1. liquid travels through the bypass line and into the vapor outlet line when a liquid level within the vessel reaches a predetermined level so that a headspace is maintained above the liquid level as liquid enters the vessel through the inlet port; and
2. liquid does not travel from the bypass line into the vapor outlet line when a liquid level within the vessel is below the predetermined level.

13. The device of claim 12 further comprising more than one liquid outlet line connected to the lower portion of the vessel so as to be in fluid communication with a liquid side of the vessel, said more than one liquid outlet line also configured to be placed in fluid communication with the heat exchanger.

14. The device of claim 12 wherein the vessel has an upper portion and a lower portion and the vapor outlet line is connected to the upper portion of the vessel above the inlet port and the liquid outlet line is connected to the lower portion of the vessel.

15. The device of claim 14 wherein the bypass line is in fluid communication with the lower portion of the vessel via a junction between the bypass line and the lower portion of the vessel that is vertically below a junction between the bypass line and the vapor outlet line.

16. The device of claim 14 wherein the bypass line is in fluid communication with the lower portion of the vessel via a junction between the bypass line and the vessel liquid outlet line that is vertically below a junction between the bypass line and the vapor outlet line.

17. The device of claim 12 wherein the bypass line outlet is in fluid communication with the vapor outlet line at a junction, where the junction is positioned vertically below the vessel vapor outlet port.

18. The device of claim 12 wherein the vessel includes a sidewall and the bypass line includes an elongated pipe portion positioned within the vessel, said elongated pipe portion having a bottom end portion including the bypass line inlet and a branch portion extending through the vessel sidewall and between the vapor outlet line and a top portion of the elongated pipe portion.

19. The device of claim 12 wherein the vessel includes a sidewall; the vapor outlet line includes an upper pipe portion positioned within the vessel and including the vapor outlet line inlet, said vapor outlet line further including a branch portion extending through the vessel sidewall and in fluid communication with the upper pipe portion and the heat exchanger; the bypass line includes a lower pipe portion positioned within the vessel and including the bypass line inlet and the bypass line outlet; and the upper and lower pipe portions are formed by a single pipe member positioned within the vessel.

* * * * *